US008627584B2

(12) United States Patent
Aiezza

(10) Patent No.: US 8,627,584 B2
(45) Date of Patent: Jan. 14, 2014

(54) GARMENT TRACKING INDICATOR

(75) Inventor: Michael Aiezza, Ellington, CT (US)

(73) Assignee: Michael Aiezza

( * ) Notice: Subject to any disclaimer, the term of this patent is extended or adjusted under 35 U.S.C. 154(b) by 287 days.

(21) Appl. No.: 12/897,859

(22) Filed: Oct. 5, 2010

(65) Prior Publication Data

US 2011/0113660 A1 May 19, 2011

Related U.S. Application Data

(63) Continuation-in-part of application No. 12/619,703, filed on Nov. 17, 2009, now Pat. No. 8,069,595.

(60) Provisional application No. 61/327,847, filed on Apr. 26, 2010.

(51) Int. Cl.
*G09F 3/00* (2006.01)

(52) U.S. Cl.
USPC ..... 40/322; 116/321

(58) Field of Classification Search
USPC ..... 40/322, 109; 116/321, 322, 323
See application file for complete search history.

(56) References Cited

U.S. PATENT DOCUMENTS

| | | | | | |
|---|---|---|---|---|---|
| 376,391 | A | * | 1/1888 | Moulton | 40/109 |
| 395,709 | A | * | 1/1889 | May | 40/109 |
| 467,119 | A | * | 1/1892 | Hawkins | 40/109 |
| 476,263 | A | * | 6/1892 | Guidinger | 40/109 |
| 1,381,881 | A | * | 6/1921 | Lely | 40/109 |
| 1,611,538 | A | * | 12/1926 | Landman | 40/109 |
| 1,921,451 | A | * | 8/1933 | Brenner | 40/109 |
| 2,169,552 | A | | 8/1939 | Bellin | |
| 2,346,342 | A | * | 4/1944 | Wilbur | 40/109 |
| 3,124,284 | A | | 3/1964 | Collum | 223/98 |
| 3,633,294 | A | | 1/1972 | Burmeister | |
| 3,698,113 | A | * | 10/1972 | Spicer | 40/118 |
| 4,075,774 | A | * | 2/1978 | Day | 40/109 |
| 4,332,580 | A | * | 6/1982 | Macchi | 493/346 |
| 4,886,010 | A | | 12/1989 | Stutzman | 116/308 |
| 5,499,466 | A | | 3/1996 | House | |
| 5,564,361 | A | | 10/1996 | Satterwhite | 116/308 |
| D430,219 | S | | 8/2000 | Chagan | |
| 6,330,969 | B1 | | 12/2001 | Villaraut | 235/64.7 |
| 6,517,922 | B2 | * | 2/2003 | Ang et al. | 428/41.8 |
| 7,246,730 | B2 | | 7/2007 | Russo | 223/85 |

* cited by examiner

*Primary Examiner* — Gary Hoge
(74) *Attorney, Agent, or Firm* — Stanton IP Law

(57) ABSTRACT

The invention is a product that allows one to determine precisely how many times a particular garment has been worn, its relative cleanliness status, the last day a garment was worn, and helps the consumer coordinate their outfits. The invention provides the necessary information to fully utilize and manage a consumer's wardrobe and closet. Using the invention dramatically increases total closet awareness resulting in faster and easier wardrobe decisions. In addition, by removing the guesswork from the "wash or wear" equation, the consumer knows when the garment is sufficiently clean, and will generally be able to extend the wearing of the garment between cleanings. Use of the invention will result in the conservation of resources in terms of reduced consumption of water, energy, detergents/softeners, and dry cleaning services and harmful dry cleaning chemicals; it will also increase the life span of garments as well as cleaning/drying appliances.

5 Claims, 19 Drawing Sheets

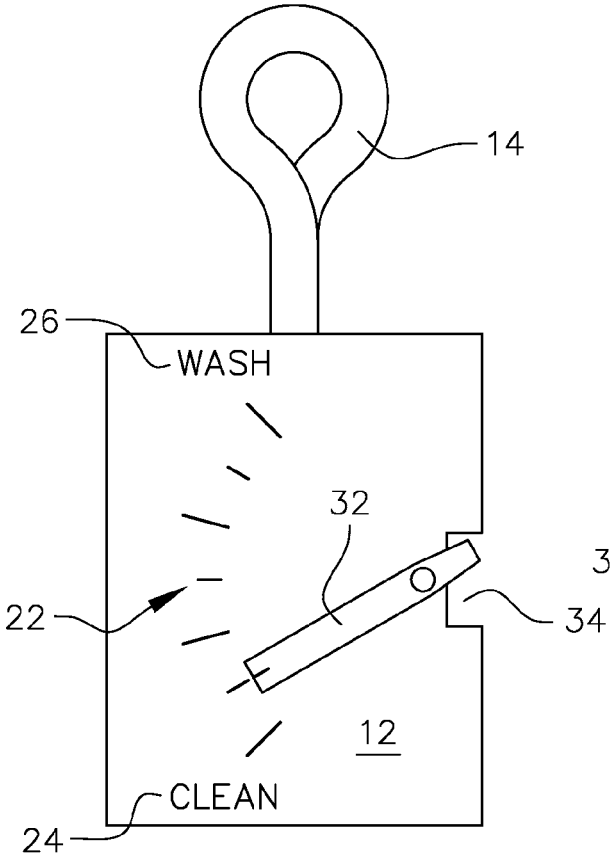
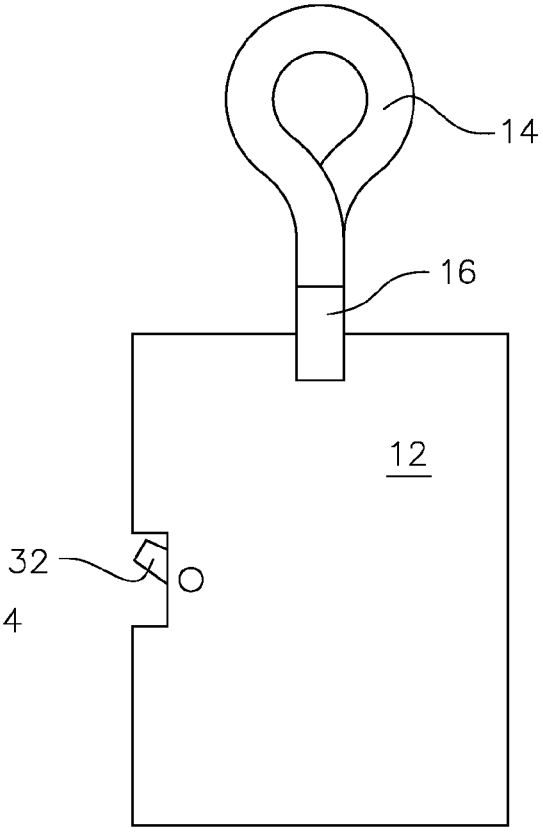
FIG. 3A
FIG. 3B

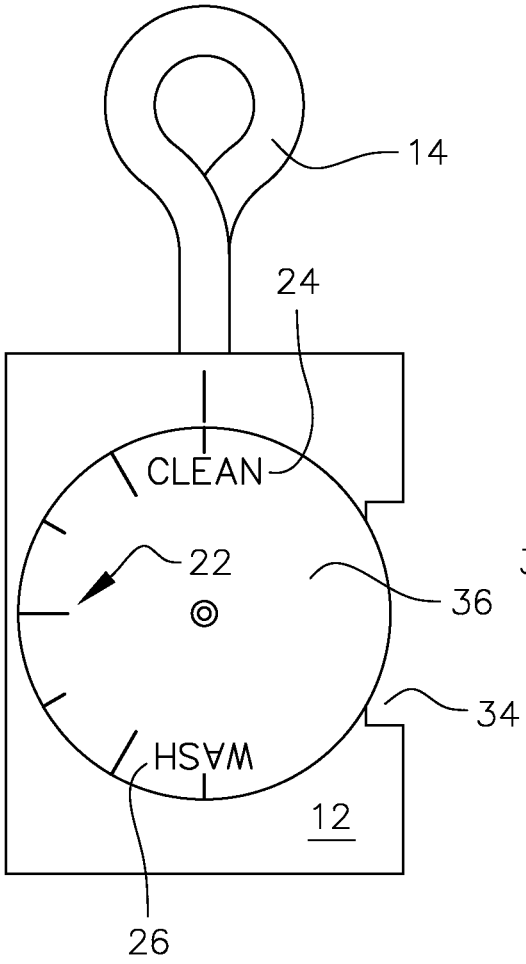
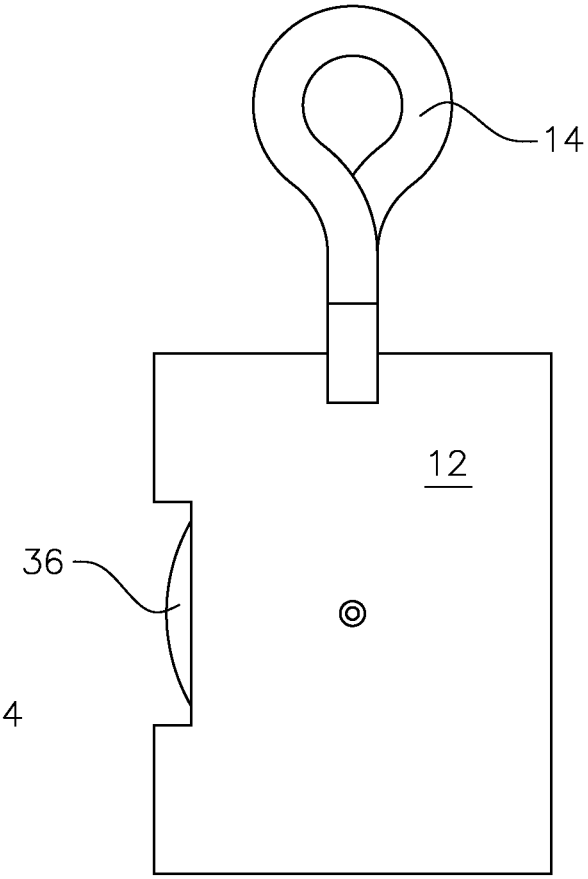
FIG. 4A
FIG. 4B

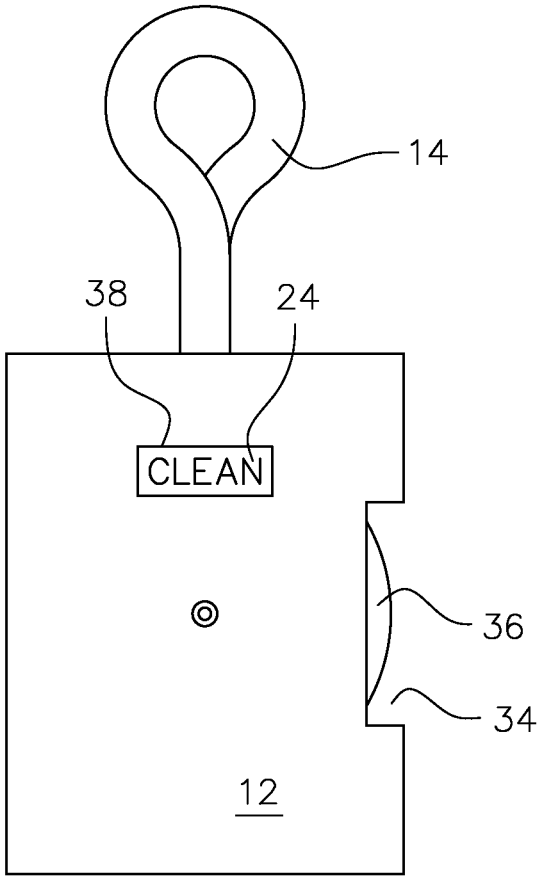
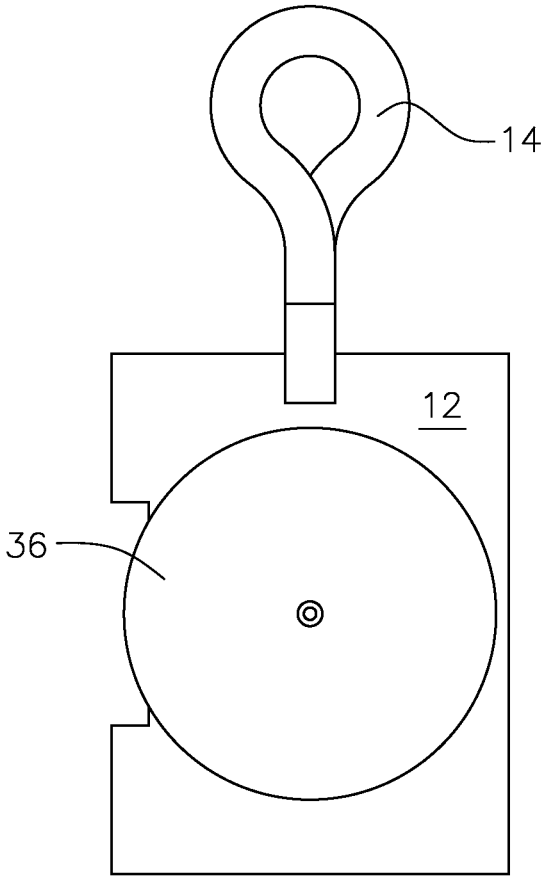
FIG. 5A
FIG. 5B

GARMENT TRACKING INDICATOR

RELATED APPLICATIONS

This application is a continuation-in-part of U.S. patent application Ser. No. 12/619,703 filed Nov. 17, 2009 and this application further claims the benefit of provisional patent application Ser. No. 61/327,847 filed Apr. 26, 2010.

FIELD OF THE INVENTION

The invention relates to an apparatus that tracks how often a garment is worn, the relative cleanliness of a particular garment, and when the consumer last wore the garment.

BACKGROUND OF THE INVENTION

Often consumers go to their closets and are unsure how often they wore a particular garment, the cleanliness status of the garment, and when they last wore the garment. What is needed is a convenient device that serves as a "clothing helper" that promotes improved garment utilization and the conservation of resources as it relates to keeping clothing clean. The invention described herein can be used with any garment that can be worn more than once.

SUMMARY OF THE INVENTION

The invention is a product that provides the necessary information to fully utilize and manage a consumer's wardrobe and closet. The invention will track the frequency of use of a particular clothing item; verify clothing freshness; keep track of when a clothing item was last worn; and assist the consumer in coordinating their outfits.

The invention is a product that allows one to determine precisely how many times a particular garment has been worn. The invention also tracks the cleanliness of the garment, which can be independent from the frequency of use. By removing the guesswork from the "wash or wear" equation, the consumer knows when the garment is sufficiently clean, and will generally be able to extend the wearing of the garment between cleanings. Use of the invention will result in the conservation of resources in terms of reduced consumption of water, energy, detergents/softeners, and dry cleaning services and harmful dry cleaning chemicals; it will also increase the life span of garments as well as cleaning/drying appliances.

Different colored lanyards or placards assist the consumer in coordinating outfits. Optional features can include indicators to note the last day of use in a week, the date of a month, and the month of the year. Using the invention dramatically increases total closet awareness resulting in faster and easier wardrobe decisions.

In one embodiment, the product comprises a card or planar surface member that can be made from a plastic stock or a paper stock or similar material, with an optionally attached closed lanyard loop at the top, a strip of material formed as a string lanyard or a ribbon like or generally flat lanyard, and an optional clear plastic protective sheathing. Connected to the top of the card is a loop which is sized and configured to slip over the top of any size clothes hanger. The loop can be formed from the same material forming the strip and be made from the same continuous length of material. The strip coming down from the loop and/or near the top edge of the member and continues through an opening or aperture on top back of the card. The strip then runs down the face of the card and exits through an opening or aperture on the bottom front side of the card; and the strip extends a sufficient length such as a few inches below the bottom of the card so that a person may hold onto the depending portion to raise the card back to the initial start position or a person can slide the card down along the extended strip as the garment is worn.

The card and strip material may optionally be substantially surrounded by a taut thin plastic sheathing, which may be open on the top and bottom of the card or have appropriate apertures for attachment points and passing through the lanyard. This keeps the lanyard material taut, which is especially helpful for use with garments in drawers or shelves.

There are a number of spaced apart horizontal lines on the front face of the card. For example, there may be seven lines indicative or representative of the seven days in a week. Alternative length lines may also be used, that is, the length of each line may vary. For example, if there are seven spaced apart lines, then four may be full length lines and three may be shorter lines. At the bottom of the card below or adjacent to the first line, there is an indicia indicative of the garment being clean. It could be text such as "I'M CLEAN" imprinted on the card or it could be a symbol or both text and a symbol. Above the top line or adjacent the top line, there is an indicia indicative of the garment having sufficient use to be sent to the cleaners or washed. It could be text such as "WASH ME" or "CLEAN ME" imprinted on the card or it could be a symbol or both text and a symbol.

The strip material when formed as a generally flat material such as a ribbon like material that runs through the card should have a clearly visible mark that by default is set and reset at the bottom of the card. A slight pulling down on the card results in the effect of the mark moving up. As the mark moves up it crosses the horizontal line which will register how often the garment has been worn or the last day of the week it was worn.

As an example of how the invention would work, when a newly cleaned garment is placed on a hanger, the mark is set on "I'M CLEAN". Each time the worn garment is returned to the hanger, the consumer pulls slightly downward on the card to register this use, that is the frequency of use and/or its cleanliness status. The downward movement of the card has the effect of the mark on the strip of ribbon like material or flat lanyard moving up one line closer to the "WASH ME" setting (on the top front of the card). When the mark reaches, "WASH ME", the garment is removed from the hanger for cleaning.

The product, which stays on the hanger, is reset by holding the card in one hand and the strip of ribbon like material or flat lanyard in the other hand and pushing the card all the way up the strip of ribbon like material or flat lanyard until the mark is set to "I'M CLEAN."

The ribbon and/or card of the invention can come in different colors to help identify clothing items when they are to be returned to the hanger. For instance a hanger with a blue ribbon or card might suggest that this hanger is for a shirt. A red ribbon or card might suggest that this hanger is for pants. The different colors also allow for grouping and coordinating outfits. For example, a skirt, a blouse, and a jacket could be easily identified with a common green ribbon present in the product.

The invention may also have scented aromas and/or odor-eaters as part of the product. The invention can also be used with clothing and textiles that are folded and are horizontally stored or shelved such as sweaters and tablecloths. The consumer would use both hands to operate invention. The invention could be placed underneath or in between the folded garment or textile.

In making the invention, the strip of ribbon like material or flat lanyard texture and card opening could be configured to effect a sensation of resistance and release associated with pulling down on the card as one passes each horizontal line on the card. In addition, it is contemplated that where some closets or bureau draws are not well lighted, day-glow type color coating on the mark of the strip of ribbon like material or flat lanyard and the horizontal lines of the card can be provided.

One way to provide for the effect of resistance is to include features on the strip of ribbon like material of flat lanyard that has regularly spaced "raises" on the strip of ribbon like material or flat lanyard, and/or regularly spaced variation to the thickness or width of the strip of ribbon like material or flat lanyard, when passing though the holes at the top and/or the bottom of the card will result in a moderate sensation of stop and go as one pulls down on the card.

The above invention can also be covered by a film of plastic to better protect the invention.

In still another embodiment similar to that described above, the lanyard extends through the upper aperture of the card and extends along the back side of the card and out the lower aperture to the front of the card. There is a pivotable arm having two parallel members saddling the card and joined at an apex that is pivotably attached near a side edge of the card near the middle of a vertical length of the card. The back side arm, typically near the tip of the arm, is attached at an intermediate location along the lanyard portion running down the back side of the card. As the card is pulled down, the arms move up and vice-versa. The arm on the front face of the card points to the indicia on the card similar to the indicia described in the aforementioned embodiment above. The indicia can be optionally located to form a half-moon dial face if desired.

In another embodiment similar to those described above, the garment tracking indicator comprises a planar member, with a loop formed from a lanyard attached near the upper edge of the planar member. The formed loop is for use in hanging the device from a hanger; an arm being pivotable attached to the planar member and manually operable; and as above, the planar member has garment worn indicia thereon representative of number of times a garment associated with the garment tracking indicator has been worn, and/or its cleanliness status, has garment cleaning needed indicia near the top edge representatively communicating to a user that said associated garment is ready to be cleaned and further has cleaned garment indicia near the bottom edge representatively communicating to the user that the associated garment is clean and ready for wear. The pivotable arm serves as a means for indicating a wear status of the garment by being manually turned to point to a desired indicia.

If a protective plastic sheathing is used, the manual operation of the pivoting arm is simply done by manually moving the small segment of the arm on the other side of the pivot point from a segment opening in the side of the protective sheathing.

In another embodiment of the present invention, the garment tracking indicator comprises a planar member having a loop formed from a lanyard attached near an upper edge of the planar member for use in hanging said device from a hangar. The planar member has a notched portion along an intermediate side edge location of said planar member. A circular dial face overlies a front side surface of the planar member and rotatably attaches at a center of the dial face to the planar member. The dial face is manually operable by rotating it. The dial face has garment worn indicia thereon representative of number of times a garment associated with the garment tracking indicator has been worn and/or the relative cleanliness status of the garment, has garment cleaning needed indicia representatively communicating to a user that the associated garment is ready to be cleaned and further has cleaned garment indicia representatively communicating to the user that the associated garment is clean and ready for wear. The rotatable dial face serves as a means for indicating a wear status of the garment by being manually turned to point a desired indicia toward a reference mark. The dial face may be configured to underlie the card and in that case the dial face can be manually rotated to allow for a visual observation of a desired indicia in a window or notched area.

If a protective plastic sheathing is used, the manual operation of the pivoting dial face is simply done by manually moving the outer edge of the dial face extending within the area of the notched portion and having that extended part of the dial face protrude somewhat through an opening in the side of the protective sheathing.

In another embodiment, the card is stationary and the lanyard or ribbon is a continuous loop ribbon that is snaked through the upper and lower apertures of the card with an reference mark on the lanyard of ribbon that aligns with the appropriate indicia.

The present invention further presents additional designs and embodiments to accomplish more or similar objectives than those described above. Many of the terms and features shown in these additional designs and embodiments are defined as appropriate above.

In one embodiment, the amount of ribbon lying on the front of the placard is reduced in length to produce a window effect by snaking the ribbon through apertures through which the ribbon runs as in the previous embodiments. The ribbon or lanyard has spaced indicia such as 0-7 (or C, 1, . . . , 7) with half steps yielding an optional count of 14 steps to indicate frequency of wear and the relative freshness or optionally the last day of the week a particular clothing item was worn. The consumer pulls down the placard till a number appears in the window which registers the above desired indicia, that is, the frequency of use, and/or the garment's state of freshness, or alternatively, the last day of the week the garment was worn. The front side of the ribbon could have the garment wear indicia while the back side of the ribbon or lanyard can have spaced indicia say from 1 to 31 of either lines or numbers representing the days in a month. If the consumer prefers to register the last date of the month the garment was worn instead of the frequency of use and/or the degree of freshness related to the wear of the product, the consumer can remove the ribbon or lanyard and rethread it so that the 1-31 indicia lie on the front side of the placard and appear in the window.

In another embodiment of the present invention, the placard has at least one track, preferably two tracks, that allow for two separate indicia or three tracks that allow for three separate indicia. One track is used to indicate the frequency of use and/or the relative freshness of the garment as it relates to the times the garment has been worn. The other track is used to register the day of the month the garment was last worn. One track may have indicia of either number or lines or both representing numbers 0-12. The second track may have indicia of either numbers or lines representing numbers 1-31. On each track there is a marker or indicia position indicator or setter which moves along the length of the track. The position indicator can be a device that is loose enough to move easily along the track and yet has enough surface resistance to maintain the desired position, such as a frictionally sliding device or a post/pin type of coupling device with a backing on one side of the invention and a knob like device on the front side of the invention. The knob may have a pointer or be configured to generally point to the indicia being registered. This marker or indicator is used to indicate the number the consumer wishes to register. Should the consumer wish to use the product solely for registering the last time the garment was worn the consumer can use the first track to register the month, 1-12, and the second track to register the day 1-31. In an alternate version of this embodiment, three tracks or slots may be incorporated where the third track has indicia for indicating the day of the week such as Sunday-Saturday, while the other two slots or tracks have corresponding indicia for indicating the date of the month (such as 1-31) and the other slot or track has indicia for indicating the month of the year (such as January-December or 1-12). In addition, a window may be configured using apertures in which the lanyard or ribbon is threaded and it having wear indicia where a specific indicia appears in the created window.

In still another embodiment, there are two wheels and at least one track or slot on the placard. The first wheel may have indicia of numbers 1-12 that appear in a window on the placard. These numbers may represent the months of the year. The second wheel may have indicia of numbers 1 through 31 which may represent the days of a month. The track on the placard may have indicia of numbers and or lines registering 0 to 7 (with 7 half step yielding 14 total steps). In addition to this 0-7 indicia to register the frequency of use and/or relative freshness of a particular garment, another indicia spaced apart from this track or slot or on a different track or slot could have indicia indicative of the day of the week such as S, M, . . . , F, S. For each set of indicia, an indicia position indicator would be incorporated to serve as the status indicator.

In still another embodiment, the ribbon or lanyard with its loop has a sliding marker along the ribbon. The marker is frictionally engaged with the ribbon. The ribbon has desired indicia as described above on one side and an optional embodiment with have additional indicia on the back side of the ribbon to make the ribbon or product reversible. As an example the frequency of use and/or the relative freshness indicia may be present on one side and the date of the month may be present on the opposite side of the ribbon or lanyard. The front side of the marker would be positioned at the desired indicia on the front side of the ribbon/lanyard. The marker used with this embodiment can be configured to have a grooved portion therein in which the ribbon or lanyard can be inserted and slidingly engaged by friction within the marker grooved portion.

The position indicators used in the slots of the above described embodiments and can be made in a number of ways as well. Typically one conceptual method is to use spaced-apart coupling members joined by a post such as the technology used in ear rings or lapel pins. The front side may optionally have a surface with an arrow to point to an adjacent indicia. Alternatively, the design could be made using a front and post member forming a narrow T-shape so that the front member and its post may be rotated so as to slip through the slot width opening and then rotated so that the cross-member of the T-shaped indicator rest across the adjacent surfaces of the placard and is essentially held in place by friction. The T-shaped indicator may be made from a single piece construction such as molded plastic or metal material, but it could also be made using technology similar to that used in cuff-links and may incorporate cuff-link like pivoting hinges.

BRIEF DESCRIPTION OF THE DRAWINGS

In the accompanying drawings:

FIG. 3A is a depiction by way of example only of another embodiment of the invention using an arm that is pivotably operated manually to point to designated indicia;

FIG. 3B is a depiction of the back side of FIG. 3A;

FIG. 4A is a depiction by way of example only of another embodiment of the invention using a rotatable dial face overlying the front face of the underlying card;

FIG. 4B is a depiction of the back side of FIG. 4A;

FIG. 5A is a depiction by way of example only of another embodiment of the invention using a rotatable dial face similar to the embodiment of FIG. 4A except the dial face now is in an underlying relationship to the card;

FIG. 5B is a depiction of the back side of FIG. 5A;

DETAILED DESCRIPTION OF THE INVENTION

Figure 1A:
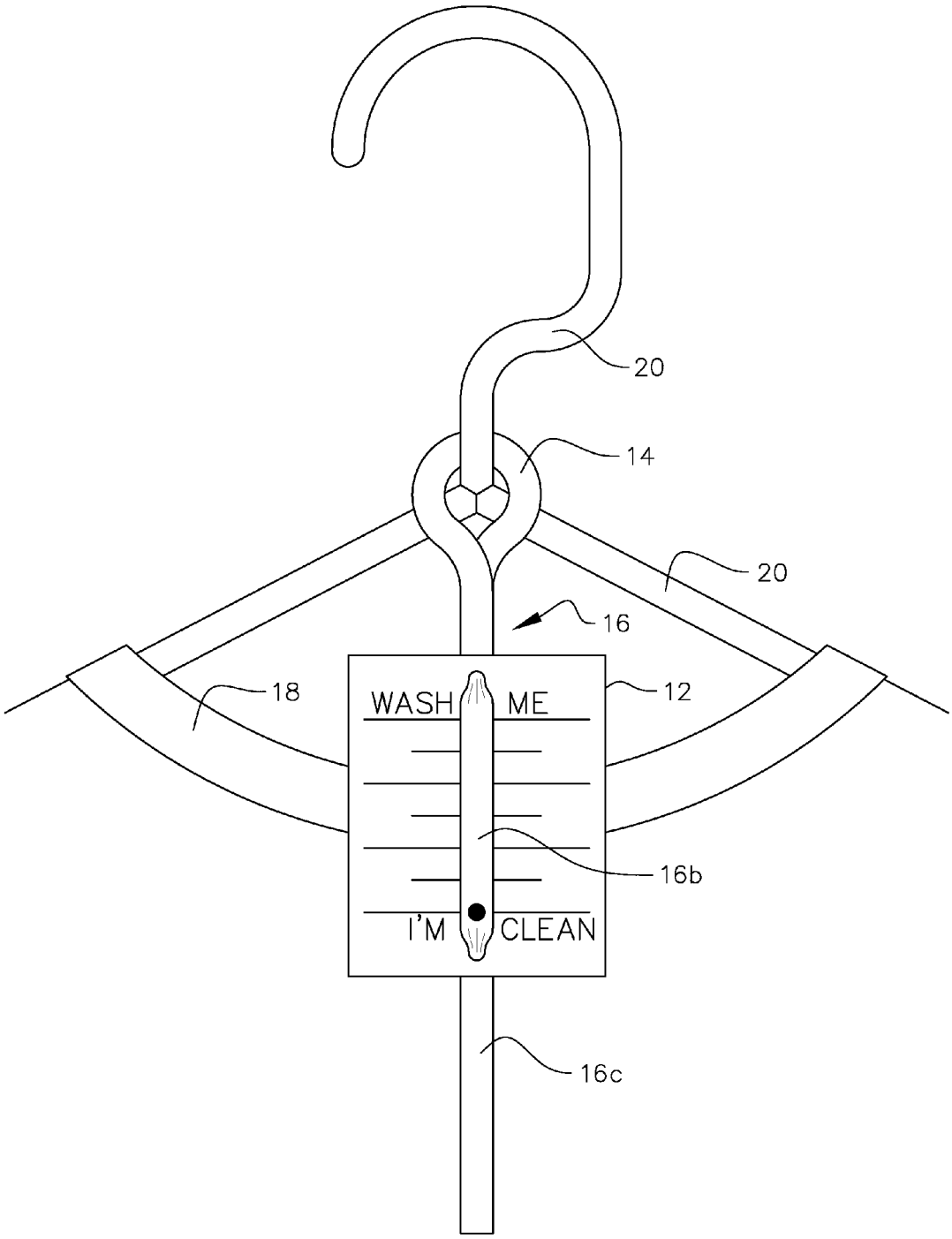
FIG. 1A is a front view of one example of the present invention in use with an associated garment and hanger.
Figure 1B:
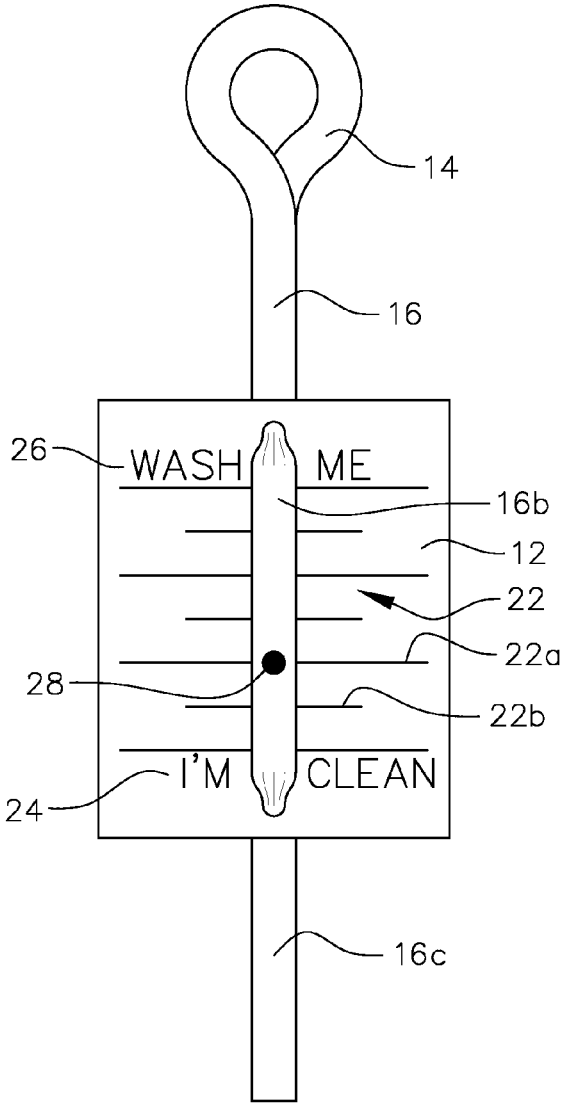
FIG. 1B is a depiction of the embodiment depicted in FIG. 1A with the mark indicating three uses and/or the relative cleanliness status or last used on the third day of the week.
Figure 1C:
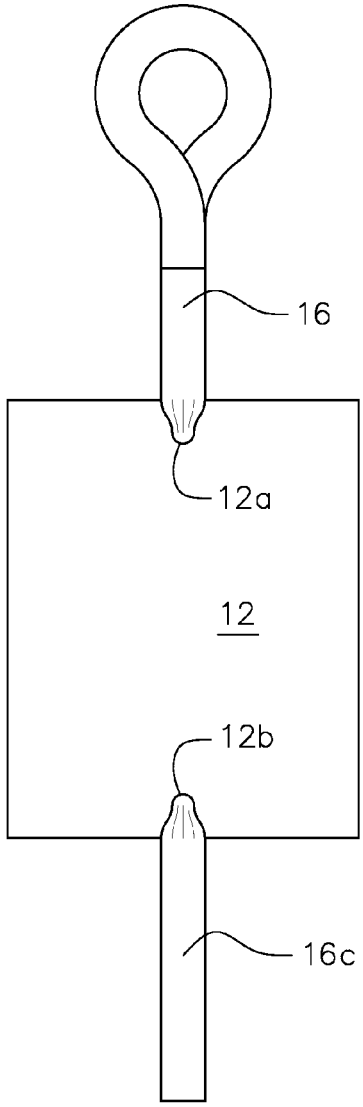
FIG. 1C is a depiction of the back side of the embodiment of FIG. 1B.
Figure 1D:
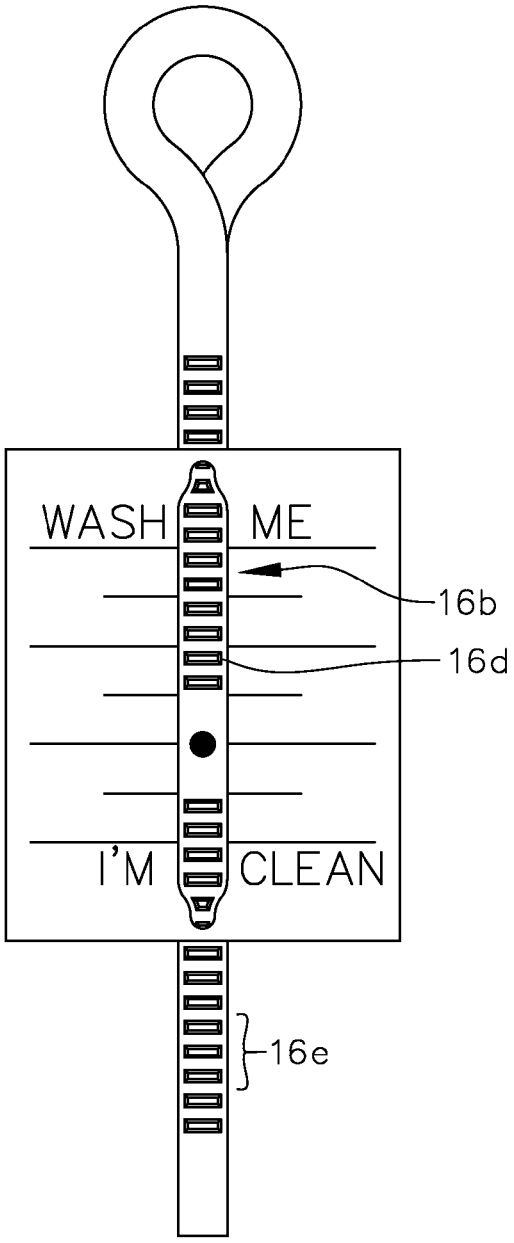
FIG. 1D is a depiction of an example of providing spaced-apart raised or thickened portions on the lanyard.
Figure 1E:
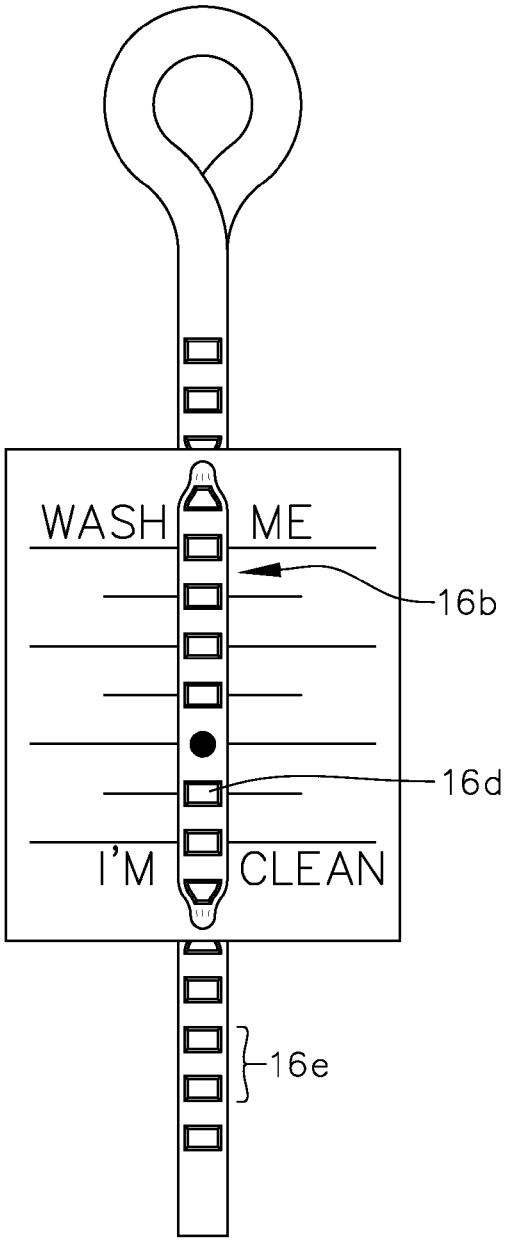
FIG. 1E is a depiction of another example of providing spaced-apart raised or thickened portions on the lanyard.
Figure 1F:
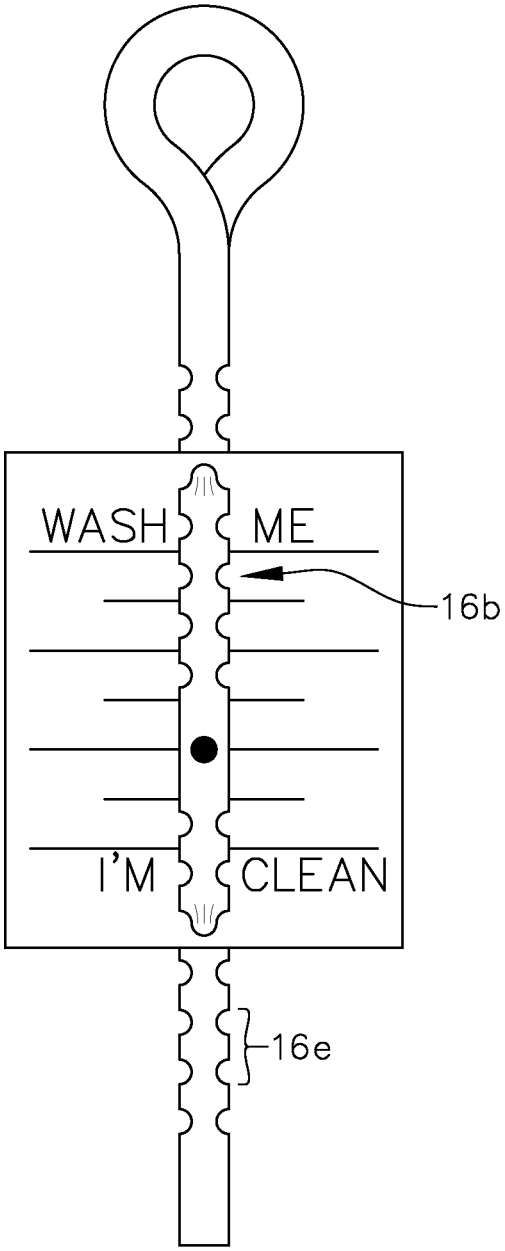
FIG. 1F is a depiction of an example of providing variable width portions on the lanyard.
Figure 2A:
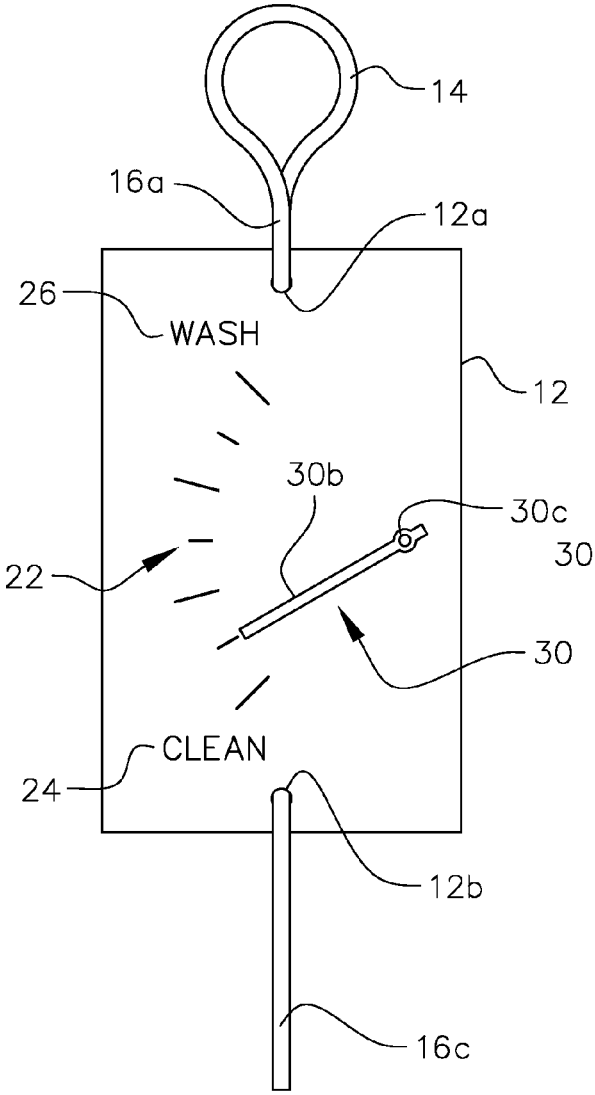
FIG. 2A is a depiction by way of example only of another embodiment of the invention using a dial in mechanical communication with the string and further showing an already worn indication.
Figure 2B:
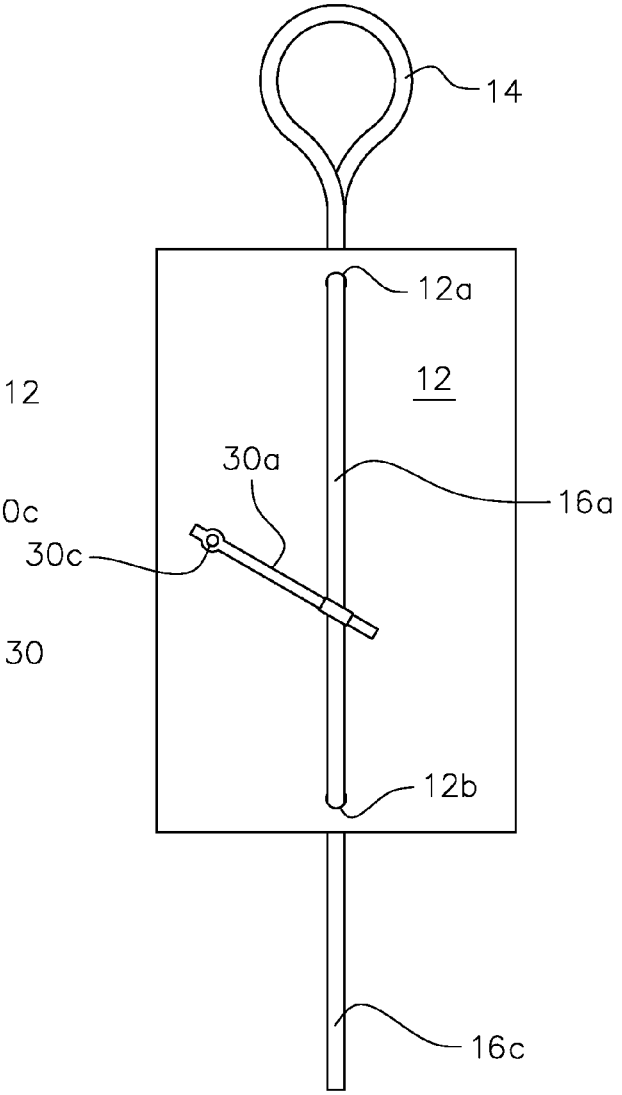
FIG. 2B is a depiction of the back side of FIG. 2A.
Figure 2C:
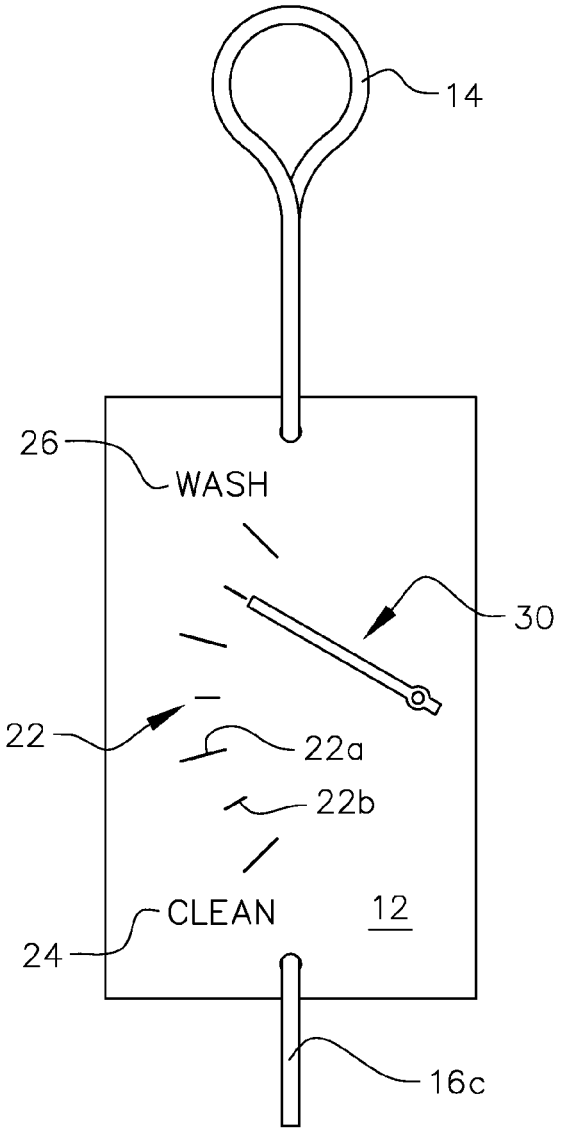
FIG. 2C is a depiction of FIG. 2A showing an indication that the garment has been worn four more times or at a later day of the week.
Figure 2D:
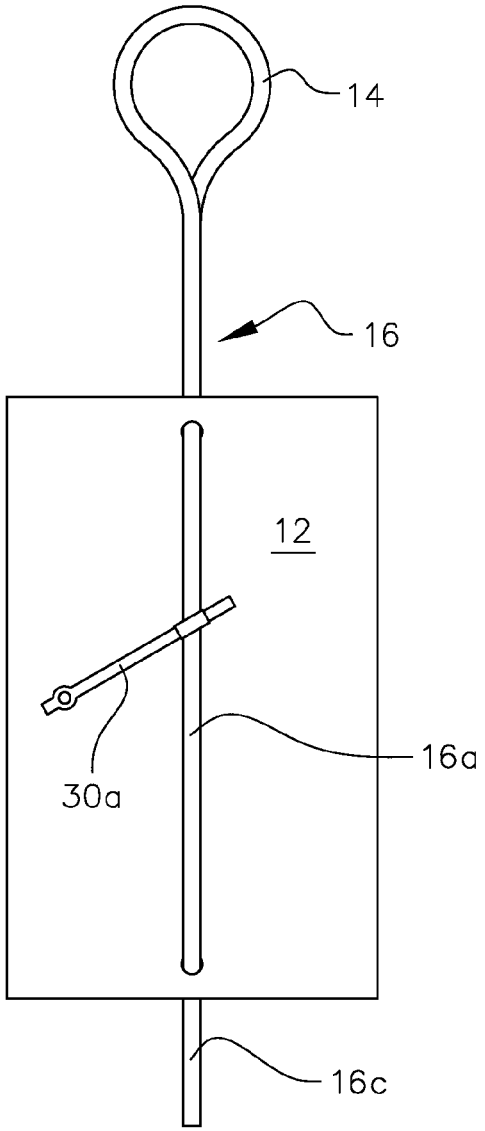
FIG. 2D is a depiction of the back side of the FIG. 2C.

Referring now to the accompanying drawings that disclose various embodiments of the present invention, which tracks how often a garment is worn, the relative cleanliness of a particular garment, and when the consumer last wore the garment.

In the first embodiment generally depicted as representative or example only in FIGS. 1A-1F, the product or invention comprises a card or planar surface member 12 that can be made from a plastic stock or a paper stock or similar material, with an optional attached closed lanyard loop portion 14 at the top, and a lanyard strip 16 of material formed as a string lanyard 16*a* (like that shown in FIGS. 2A-2D) or a ribbon like or generally flat lanyard 16*b*. An optional clear plastic protective sheathing (not shown) may be included to protect the invention. Loop 14 can be formed at the top of the card 12. Loop 14 is sized and configured to slip over the top of any size clothes hanger 20. Loop 14 can be formed from the same material forming the strip and be made from the same continuous length of material. The strip 16 coming down from the loop 14 or near the loop 14 continues through an opening 12*a* on top of the card 12 and runs down the face of the card 12 and exits through an opening 12*b* on the bottom front side of the card 12. Strip 16 extends a sufficient length such as a few inches below the bottom of the card 12 so that a person may hold onto the depending portion 16*c* to raise the card 12 back to the initial start position or a person can slide the card 12 down along the extended strip 16*c* as the garment 18 is worn.

As mentioned above, the card and strip material may optionally be substantially surrounded by a taut thin plastic sheathing, which may be open on the top and bottom of the card 12 or have appropriate apertures for attachment points and lanyard pass-throughs. This keeps the lanyard 16 material taut, which is especially helpful for use with garments 18 in drawers or shelves.

There are a number of spaced apart horizontal lines 22 on the front face of the card 12 that represent garment worn indicia. For example, there may be seven lines 22 indicative or representative of the seven days in a week. Alternative length lines may also be used, that is, the length of each line may vary. For example, if there are seven spaced apart lines 22, then four may be full length lines 22*a* and three may be shorter lines 22*b*. At the bottom of the card 12 below or adjacent to the first line 22, there is an indicia indicative of the garment 18 being clean or "garment clean" indicia 24. It could be text such as "I'M CLEAN" imprinted on the card or it could be a symbol or both text and a symbol. Above the top line 22 or adjacent the top line 22, there is an indicia indicative of the garment having sufficient use to be sent to the cleaners or washed or "garment cleaning needed" indicia 26. It could be text such as "WASH ME" or "CLEAN ME" imprinted on the card or it could be a symbol or both text and a symbol. The lines 22 can be representative of the number of times a garment 18 has been worn and/or its relative cleanliness status or indicative of the last day worn.

It should be understood that throughout this written description, reference 22 may be a "dot", a horizontal line, or any desired symbol used for the indicia reference 22 as a primary indicia position or as an intermediate indicia position.

The strip material when formed as a generally flat material such as a ribbon like material that runs through the card should have a clearly visible mark 28 like a Dot (shown in the drawings by example only), Arrow Symbol, or Horizontal Line, or any such similar equivalent indicator marking that by default is set and reset at the bottom of the card 12. Mark 28 serves as means for indicating the wear status of the associated garment. A slight pulling down on the card 12 results in the effect of the mark 28 moving up. As the mark 28 moves up it crosses one of the horizontal lines 22 which will register how often the garment has been worn and/or the relative cleanliness status registered by the consumer upon returning the garment to the hanger, or the last day of the week it was worn.

As an example of how the invention would work when a newly cleaned garment 18 is placed on a hanger 20, the mark is set on "I'M CLEAN". Each time the worn garment 18 is returned to the hanger 20, the consumer pulls slightly downward on the card 12 to register this use. The downward movement of the card has the effect of the mark 28 on the strip 16 of ribbon like material or flat lanyard moving up one line closer to the "WASH ME" setting (on the top front of the card 12). When the mark 28 reaches, "WASH ME", the garment is removed from the hanger 20 for cleaning.

The product, which stays on the hanger 20, is reset by holding the card 12 in one hand and the strip 16*c* of ribbon like material or flat lanyard in the other hand and pushing the card 12 all the way up the strip 16*b* of ribbon like material or flat lanyard until the mark is set to "I'M CLEAN."

The invention can also be used with clothing and textiles that are folded and horizontally stored or shelved such as sweaters and tablecloths. The consumer would use both hands to operate invention. The invention could be placed underneath or in between the folded garment 18.

In making the invention, the strip 16*b* of ribbon like material or flat lanyard texture and card opening could be configured to effect a sensation of resistance and release associated with pulling down on the card as one passes each or some of the horizontal line 22 on the card 12. In addition, it is contemplated that where some closets or bureau draws are not well lighted, day-glow type color coating on the mark 28 of the strip 16*b* of ribbon like material or flat lanyard and the horizontal lines 22 of the card can be provided.

One way to provide for the effect of resistance is to include features on the strip 16*b* of ribbon like material of flat lanyard that has regularly spaced "raises" or raised or thickened portions 16*d* on the strip 16*b* of ribbon like material or flat lanyard, or variable width portions 16*e* of the strip 16*b* of ribbon like material or flat lanyard, when passing though the opening at the top of the card 12 will result in a moderate sensation of stop and go as one pulls down on the card 12.

The above embodiment can also be covered by a film of plastic protective sheathing to better protect the invention.

In still another embodiment similar to that the described above and representatively depicted by way of example only in FIGS. 2A-2D, the lanyard 16, which typically is in the form of a string 16*a*, extends from near the top of the card 12, through the upper hole 12*a* and extends along the back side of the card 12 and out the lower aperture 12*b* to the front of the card. There is a pivotable arm 30 having two parallel members saddling the card 12 and joined at an apex 30*c* that is pivotably attached near a side edge of the card 12 near the middle of a vertical length of the card 12. The member 30 saddles the card 12 with one arm 30*a*,30*b* on each side of the card 12. The back side arm 30*a*, typically near the tip of the arm 30*a*, is attached at an intermediate location along the lanyard portion 16*a* running down the back side of the card 12. As the card 12 is pulled down, the arms 30*a*, 30*b* move up and vice-versa. The arm 30*b* on the front face of the card 12 points to the indicia 22, 24, 26 on the card 12 similar to the indicia described in the aforementioned embodiment above. The indicia 22, 24, 26 can be optionally located to form a half-moon dial face if desired.

In another embodiment similar to those described above and generally depicted by example only in FIGS. 3A-3B, the garment tracking indicator comprises a planar member 12, with a loop 14 formed from a lanyard attached near an upper edge of the planar member 12. The formed loop 14 is for use in hanging the device from a hanger 20; an arm 32 being pivotable attached to the planar member 12 and manually operable; and as above, the planar member 12 has garment worn indicia 22 thereon representative of number of times a garment 18 associated with the garment tracking indicator, has been worn and/or its relative cleanliness, or alternately the last day of the week worn, has garment cleaning needed indicia 26 near the top edge representatively communicating to a user that said associated garment 18 is ready to be cleaned and further has cleaned garment indicia 24 near the bottom edge representatively communicating to the user that the associated garment 18 is clean and ready for wear. The pivotable arm 32 serves as a means for indicating a wear status of the garment by being manually turned to point to a desired indicia 22,24,26. The arm 32 is attached to the card 12 in such a way that there is sufficient compression to ensure that it remains in a designated position. A notched portion 34 of the card can optionally be provided with a small segment of the arm 32 extending beyond the arm pivot point extending into the notched area and the arm 32 could then be manipulated by rotating the end of the arm 32 extending into the notched area. If a protective plastic sheathing (not shown) is used, the manual operation of the pivoting arm 32 is simply done by manually moving the small segment of the arm 32 on the other side of the pivot point from a segment opening in the side of the protective sheathing.

In another embodiment of the present invention generally depicted by way of examples only in FIGS. 4A-4B and a similar reversed arrangement of this embodiment depicted in FIGS. 5A-5B, the garment tracking indicator comprises a planar member 12 having a loop 14 formed from a lanyard attached near an upper edge of the planar member 12 for use in hanging the device from a hanger 20. The planar member has a notched portion 34 along an intermediate side edge location of the planar member 12. As shown in FIGS. 4A-4B, a circular dial face 36 overlies a front side surface of the planar member 12 and rotatably attaches at a center of the dial face 36 to the planar member 12. Alternatively, as shown in FIGS. 5A-5B, the dial face 36 may be in an underlying relationship to the planar member 12. The dial face 36 is manually operable by rotating it. The dial face has garment worn indicia 22 thereon representative of number of times a garment associated with the garment tracking indicator has been worn and/or the relative cleanliness status, has garment cleaning needed indicia 26 representatively communicating to a user that the associated garment is ready to be cleaned and further has cleaned garment indicia 24 representatively communicating to the user that the associated garment is clean and ready for wear. The pivotable dial face 36 serves as a means for indicating a wear status of the garment by being manually turned to point a desired indicia 22,24,26 toward the notched portion 34. In the FIGS. 5A-5B embodiment, the indicia 22,24,26 can be visible in the window area created by the notch portion 34 or cut out window 38.

If a protective plastic sheathing (not shown) is used, the manual operation of the pivoting dial face 36 is simply done by manually moving the outer edge of the dial face 36 extending within the area of the notched portion 34 and having that extended part of the dial face 36 protrude somewhat through an opening in the side of the protective sheathing.

Figure 6A:
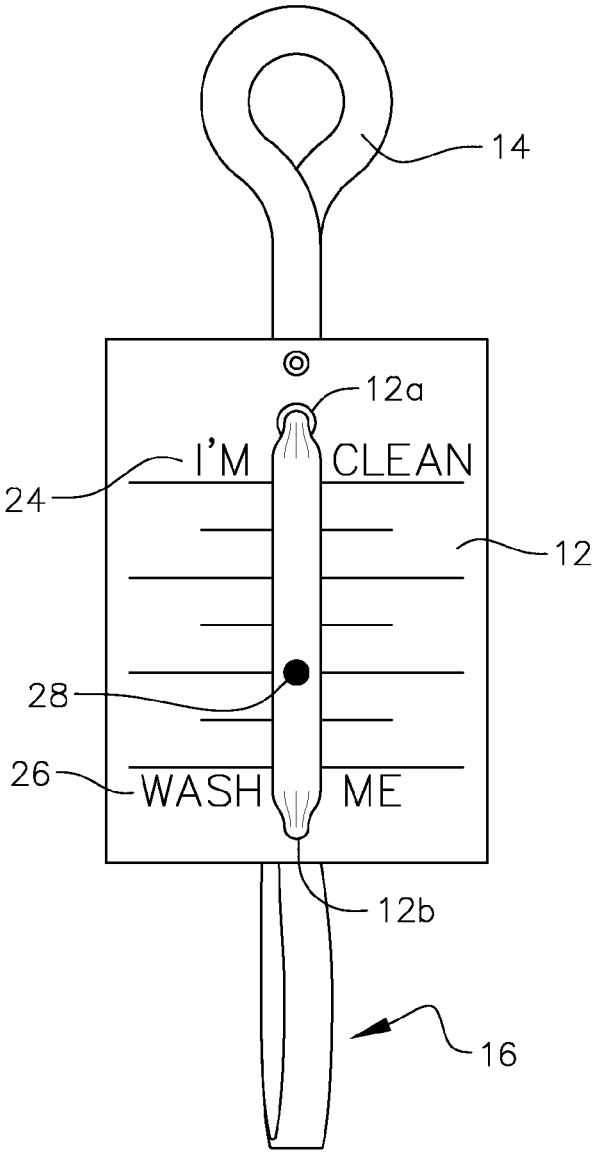
FIG. 6A is a depiction by way of example only of another embodiment of the invention that is the reverse of the FIG. 1A invention in that the card is stationary and the lanyard or ribbon is snaked through the upper and lower apertures on the card and the front and back portions of the ribbon are pulled as appropriate.
Figure 6B:
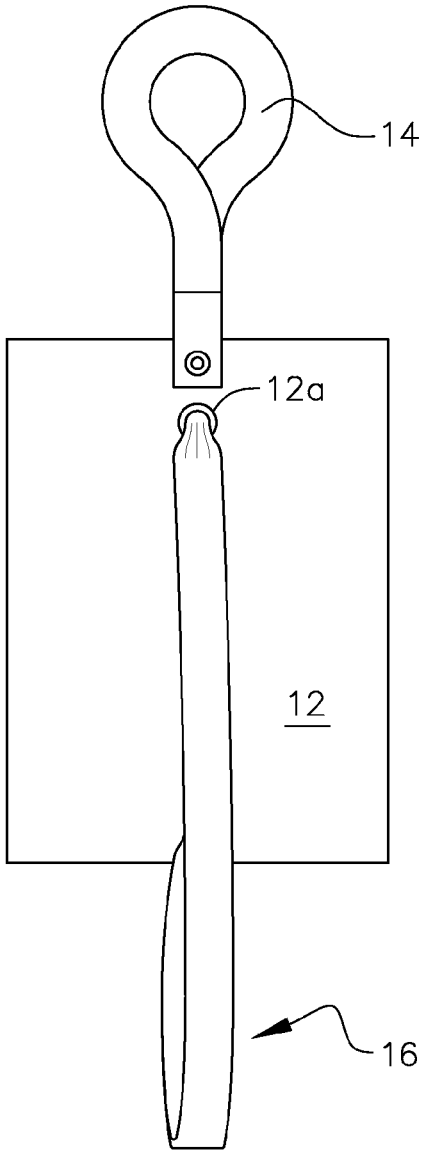
FIG. 6B is a depiction of the back side of FIG. 6A.

In still another embodiment depicted representationally by way of example only in FIGS. 6A-6B, is a depiction of an invention that operates in a reverse way to that of the invention of FIG. 1A in that the card 12 is stationary and the lanyard or ribbon 16 is snaked through the upper and lower apertures 12*a*, 12*b* on the card 12 in a continuous loop configuration. The front and back portions of the lanyard or ribbon 16 are pulled as appropriate to align a reference mark 28 with the desired indicia 22,24,26. Although not shown in FIGS. 6A-6B, it is understood that the features depicted in FIGS. 1D-1F may be incorporated with the invention of FIGS. 6A-6B, in particular, the spaced-apart raised or thickened portions 16*d* on the surface of the generally flat surface portion or spaced-apart width variations in thickness 16*e* of the generally flat surface portion, wherein as the lanyard 16 is pulled and the generally flat surface portion passes through the upper and lower apertures 12*a*, 12*b*, a sensation of stop and go is achieved.

All of the above embodiments can also be covered by a film of plastic protective sheathing to better protect the invention.

Figure 7A:
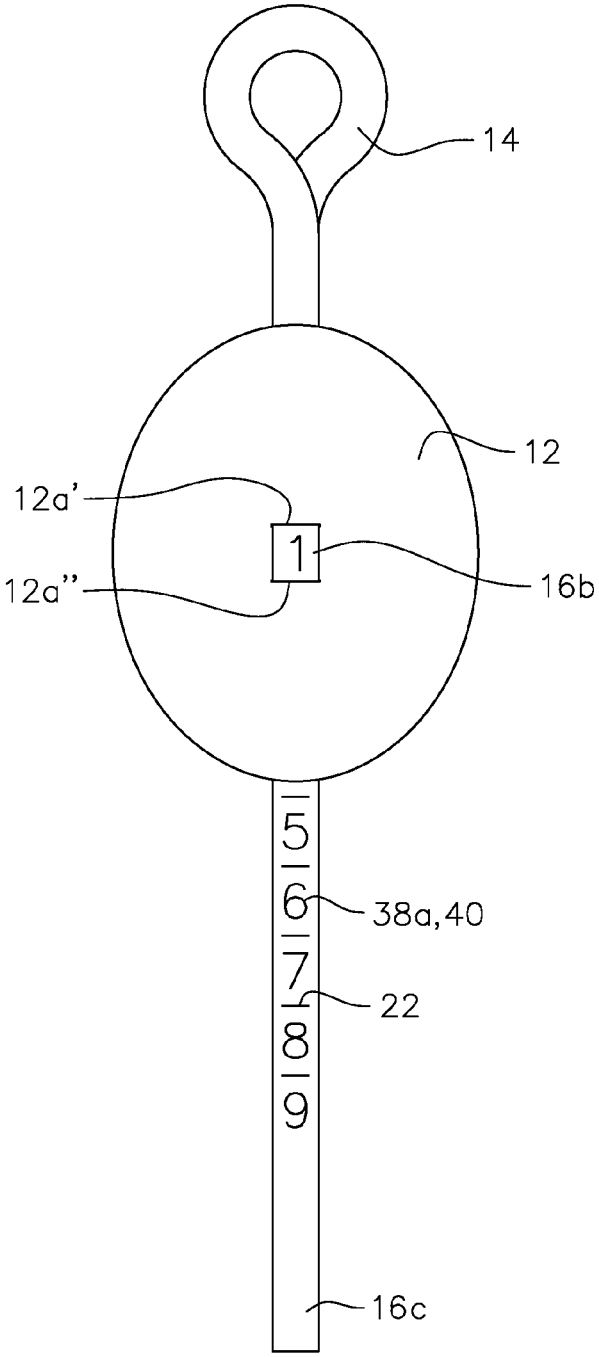
FIG. 7A is a depiction by way of example only of another embodiment of the invention with a smaller window where the ribbon having indicia thereon is snaked through the card so as to show a specific desired indicia such as the frequency of wear and/or relative cleanliness status, or alternatively the last day of the week an item was worn.
Figure 7B:
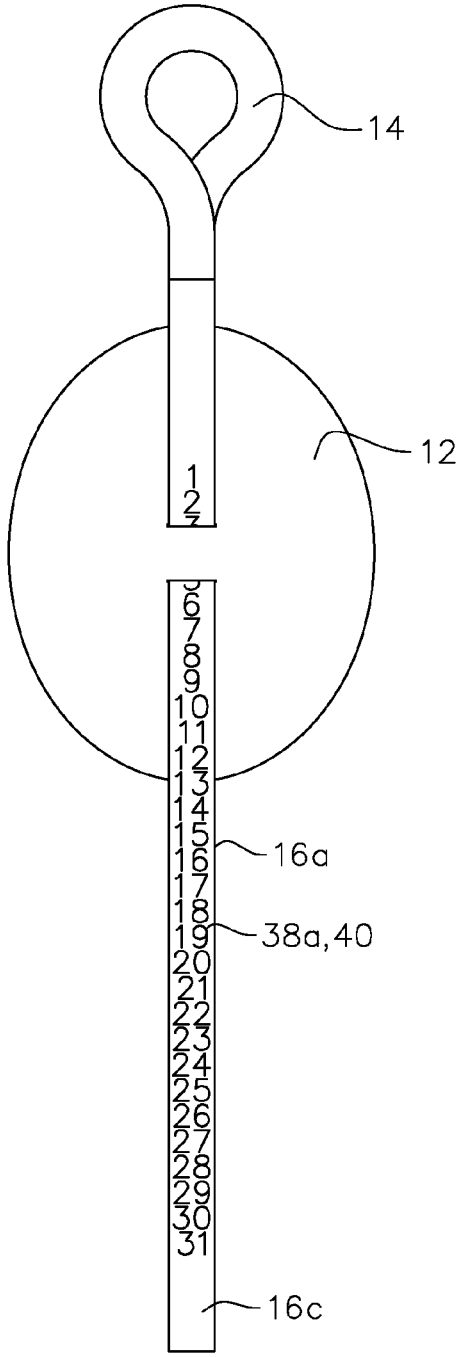
FIG. 7B is a depiction of the back side of FIG. 7A with optional indicia on the backside to represent the date of the month to make the ribbon or lanyard reversible.
Figure 7C:
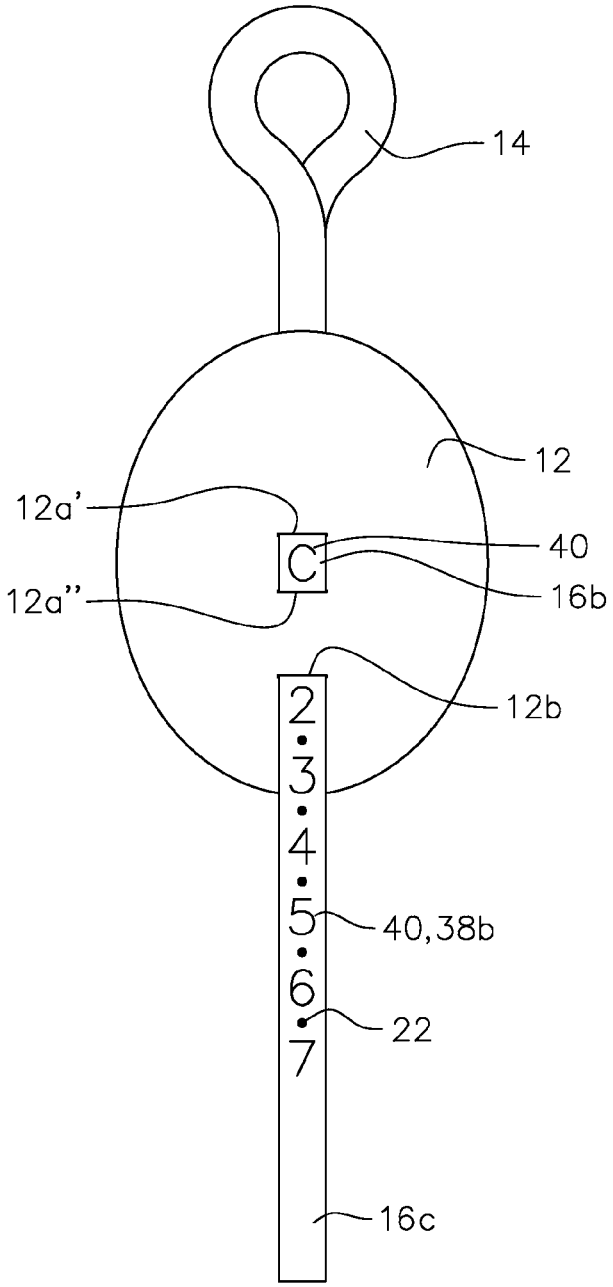
FIG. 7C is a depiction by way of example only of another embodiment of the invention where the ribbon having indicia thereon is snaked through the card so as to depict a specific desired indicia, more specifically, the wear status of the garment worn, in this case, "C" being shown, with a wear range of 1-7 with half steps between each number, represented by way of example in the drawing as "dots" but such horizontal lines or other indicia indicators may be substituted for such dots, thereby yielding a total of 14 steps, if so desired, plus the "C" position.
Figure 7D:
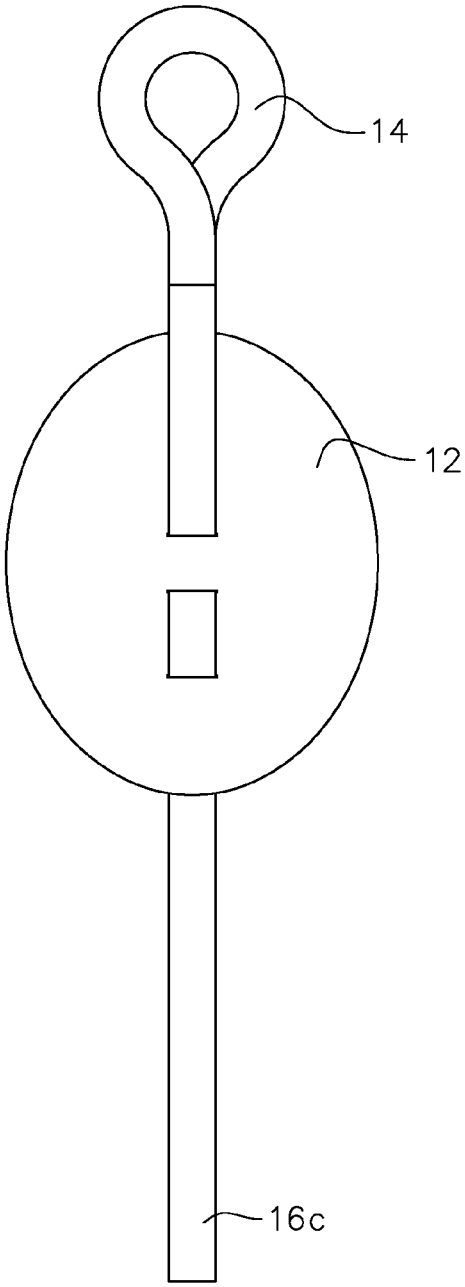
FIG. 7D is a depiction of the back side of FIG. 7C.

In one embodiment as shown in FIGS. 7A-7D, the amount of ribbon 16*b* lying on the front of the placard 12 is reduced in length to produce a window effect by snaking the ribbon 16*b* through apertures 12*a*' and 12*a*" through which the ribbon 16*b* runs as in the previous embodiments. The ribbon 16*b* or lanyard has spaced-apart indicia 40 such as 0-7 and can have half steps (such as 7 half steps 22 for a total of 14 steps if so desired) to indicate the frequency of wear and/or the relative state of cleanliness 40, or alternately the last day of the week 38*b* a garment 18 was worn or indicia 38*a* such as 1-31 to indicate date of the month. The consumer pulls down the placard till a number appears in the window which registers the above desired indicia, in their opinion, the garment's state of freshness after it has been worn and/or the frequency of use or alternatively the last day of the week the garment was worn. The front side of the ribbon 16*b* could have the garment wear indicia 40 while the back side back side of the ribbon or lanyard 16*b* can have spaced indicia 38*a* say from 1 to 31 of either lines or numbers representing the days in a month. If the consumer prefers to register the last day of the month the garment was worn instead of the frequency of use or the degree of freshness related to the wear of the product, the consumer can remove the ribbon or lanyard 16*b* and rethread it so that the 1-31 indicia lie on the front side of the placard and appear in the window. As shown in FIG. 7C, the ribbon 16 may be optionally snaked through a slotted aperture 12*b* in the card 12 and the remaining ribbon 16*c* will depend or hang behind and below the card 12.

Figure 8A:
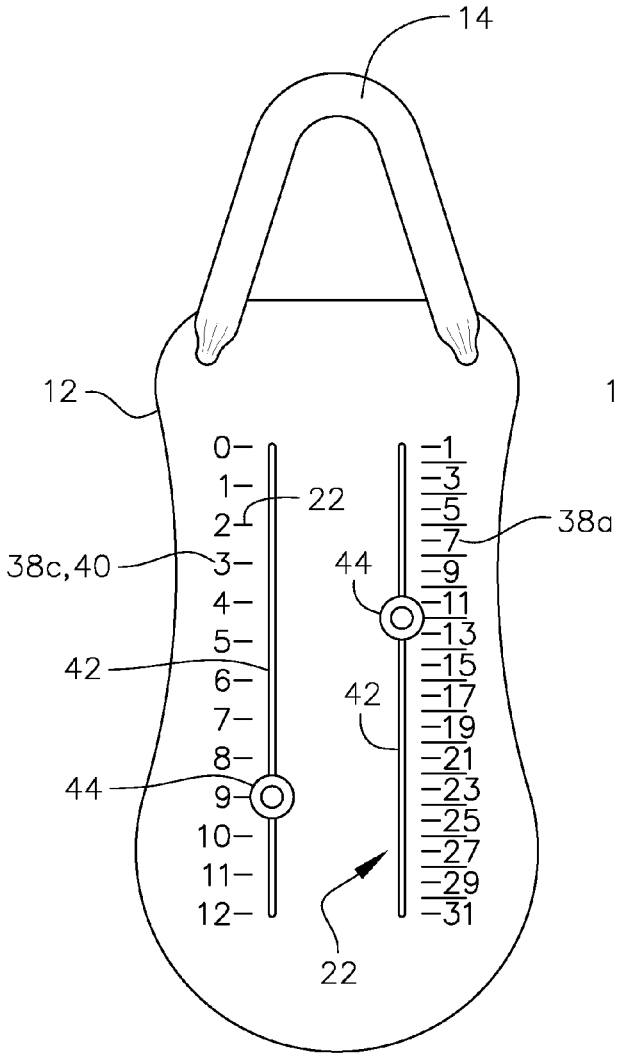
FIG. 8A is a depiction by way of example only of another embodiment of the invention where the card has two tracks or slots with adjacent respective indicia, in this case, frequency of wear and or relative cleanliness status, or alternatively the month of the year 1-12 for each month and 1-31 for each date of a month and indicia positioning indicators are adjustably fixed adjacent a desired indicia for each track or slot.
Figure 8B:
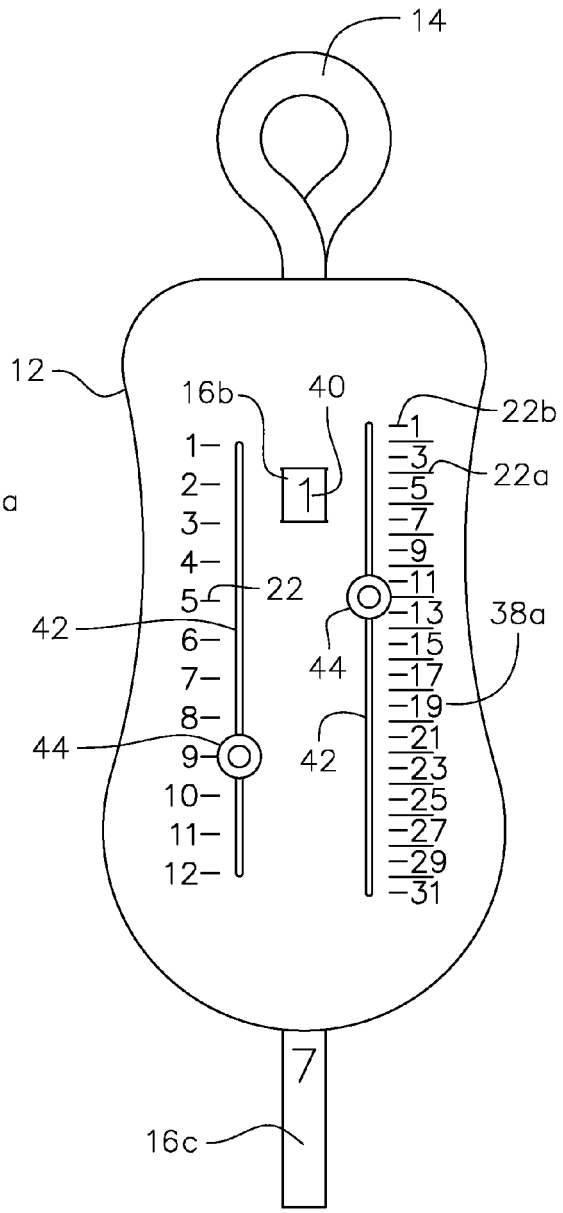
FIG. 8B is a depiction similar to FIG. 8A which further incorporates a ribbon that is snaked through apertures in the card so as to show a desired number on the face of the card, in this case, the desired number is indicative of frequency of wear and or relative cleanliness status of "1" from a range such as "C" or "0" for clean and followed by 1-7 (with optional half steps yielding a total of 14 steps) or indicative of the last day of the week a garment was worn.
Figure 8C:
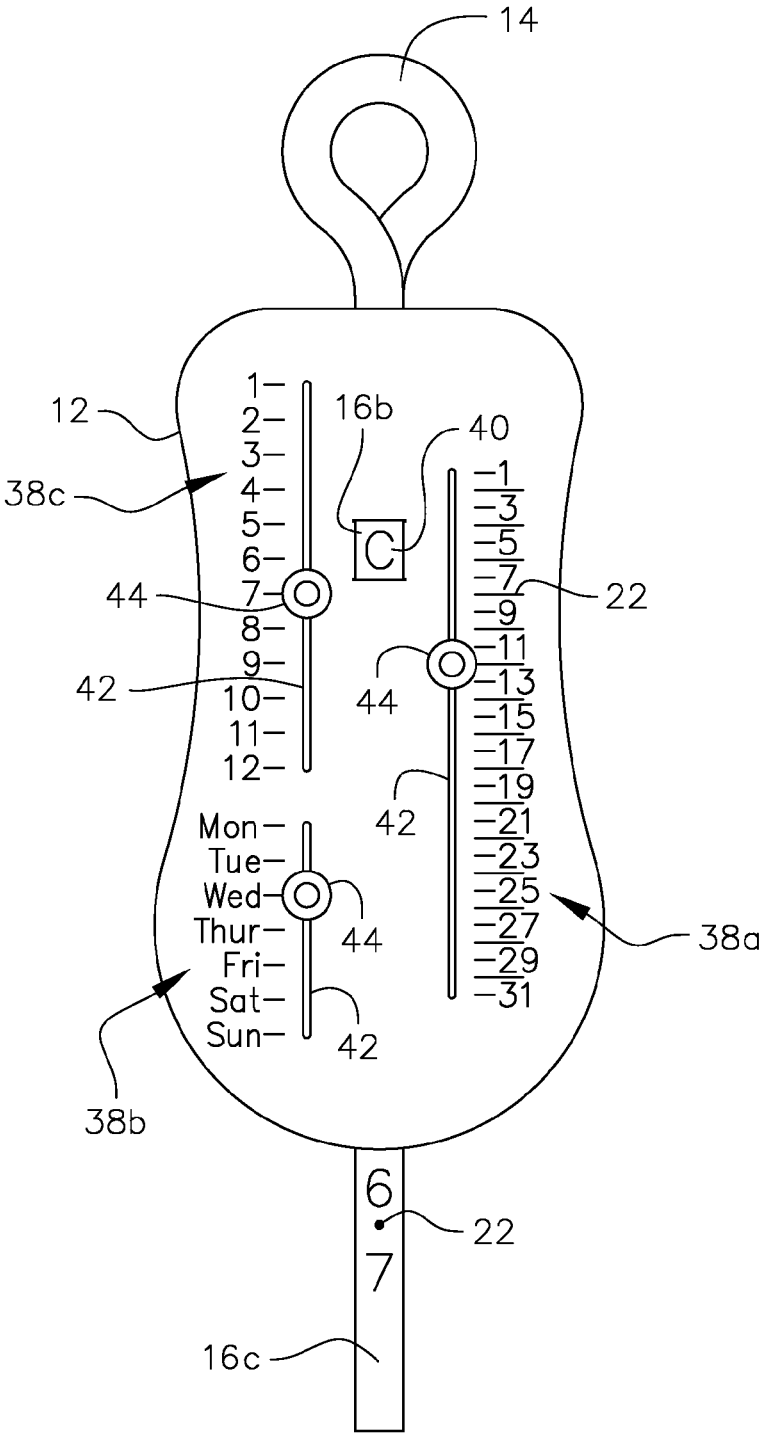
FIG. 8C is a depiction similar to FIG. 8B further comprising three slots or tracks instead of the two slots or tracks of FIGS. 8A-8B, where by way of example, the tracks respectively show indicia representative of the months, day of the week and date of the month.

In another embodiment of the present invention as shown in FIGS. 8A-8C, the placard 12 has two tracks or slots 42 that allow for two separate indicia sets or three tracks or slots 42 that allow for three separate indicia sets. One track counts the wear indicia 40 as it relates to the times the garment has been worn and or the relative freshness of the garment or the number of the month 38*c*. The other track may register the day of the month 38*a* the garment was last worn. One track may have indicia of either numbers or lines 22*a*, 22*b* or both representing numbers 0-12 for the month 38*c* or the wear status 40. The second track may have indicia of either numbers or lines 22*a*, 22*b* representing numbers 1-31 for the date of the month 38*a*. On each track there is a marker or indicia position indicator 44 or setter which moves along the length of the track or slot 42. This can be a device that is loose enough to move easily along the track and yet has enough surface resistance to maintain the desired position. This marker is used to indicate the number the consumer wishes to register. Should the consumer wish to use the product solely for registering the last time the garment was worn the consumer can user the first track to register the month, 1-12, and the second track to register the day 1-31. In an alternate version of this embodiment, three tracks or slots 42 may be incorporated where the third track has indicia for indicating the day of the week 38*b* such as Sunday-Saturday, while the other two slots or tracks have corresponding indicia 38*a* for indicating the date of the month (such as 1-31) and the other slot or track 42 has indicia 38*c* for indicating the month of the year (such as January-December). As shown in FIGS. 8B and 8C, the invention may further include a ribbon and window effect similar to that shown in FIGS. 7A-7D where the ribbon 16*b* includes indicia 40 such as "C" or "0" for clean and 1-7 (and may have 7 half steps 22 for a total of 14 optional steps) to show progressive use or wear of an associated garment and/or its relative cleanliness. FIGS. 12A-12B and 13A-13B are conceptual depictions of examples of an engaging post marker 44 that can be used in the slotted portions 42 of the embodiments depicted in FIGS. 8A-8C. These position indicators 44 used in the slots of the above described embodiments and can be made in a number of ways. Typically one conceptual method is to use spaced-apart coupling members joined by a post 44*c* such as the technology used in ear rings or lapel pins. The front side 44*a* may optionally have a surface with an arrow 44*d* to point to an adjacent indicia. Alternatively, the design could be made using a front and post member forming a narrow T-shape such as that depicted in FIGS. 13A-13B so that the front member 44*a* and its post 44*c* may be rotated so as to slip through the slot width opening 42 and then rotated so that the cross-member of the T-shaped indicator rest across the adjacent surfaces of the placard 12 and is essentially held in place by friction. Although, the position indicator 44 shown in FIGS. 13A-13B may be made from a single piece construction such as molded plastic or metal material, it could be made using technology similar to that used in cuff-links and may incorporate cuff-link like pivoting hinges.

Figure 9A:
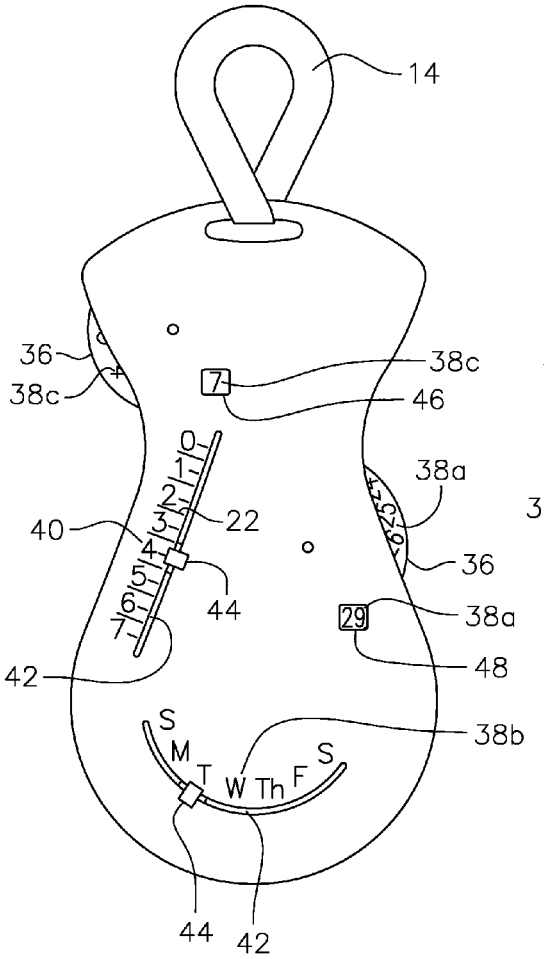
FIG. 9A is a depiction by way of example only of another embodiment of the invention where the card has two tracks or slots with adjacent respective indicia similar to FIGS. 8A and 8B, in this case, showing indicia representative of the frequency of wear and or relative cleanliness status 0-7 (with optional 7 half steps) and day of the week, where this embodiment further includes two manually adjustable rotatable dial faces with indicia around a perimeter of each dial face and two corresponding window apertures configured so that desired indicia is shown in each window when the dial face is rotated to set the desired indicia and where in this case, the date of the month is shown in one window while the number of the month is depicted on the other window.
Figure 9B:
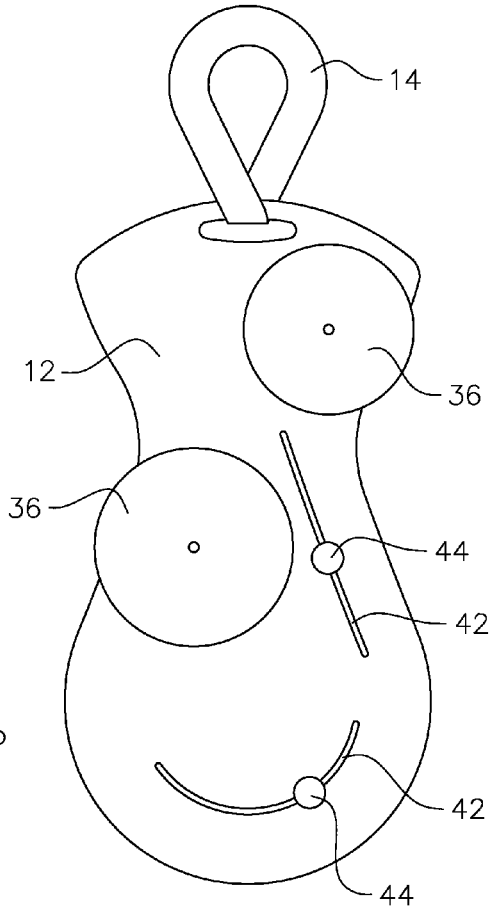
FIG. 9B is a depiction of the back side of FIG. 9A.

In still another embodiment and as shown in FIGS. 9A-9B, by way of example only and not limited thereto, there are two wheels or dial faces 36 and at least one track or slot 42 on the placard 12. The first wheel 36 may have indicia 38*c* made up of numbers 1-12 that appear in a window 46 on the placard 12. These numbers may represent the months of the year. The second wheel may have indicia 38*a* made up of numbers 1-31 that appear in a window 48 which may represent the days (date) of a month. The track or slot 42 on the placard 12 may have indicia 40 made up of numbers and or lines registering 0 to 7 (and may have 7 half steps 22 for a total of 14 optional steps) to mark the wear status (frequency count and/or relative cleanliness or alternately, the last day of the week the garment was worn) of the associated garment. In addition to this 0-7 indicia to register the wear status, that is, the relative freshness versus wear of a particular garment, another indicia spaced-apart from this track or slot 42 or on a difference track or slot 42 could have indicia 38*b* indicative of the day of the week such as S, M, . . . , F, S. For each set of indicia, an indicia position indicator 44 would be incorporated to serve as the position status indicator being tracked. This position setting indicator 44 is configured to be a device that is loose enough to move easily along the track and yet has enough surface resistance to maintain the desired position along the track or slot 42 until adjusted again later on. The position indicator 44 can be made similar to that described above and depicted in FIGS. 12A-12B and 13A-13B.

Figure 10:
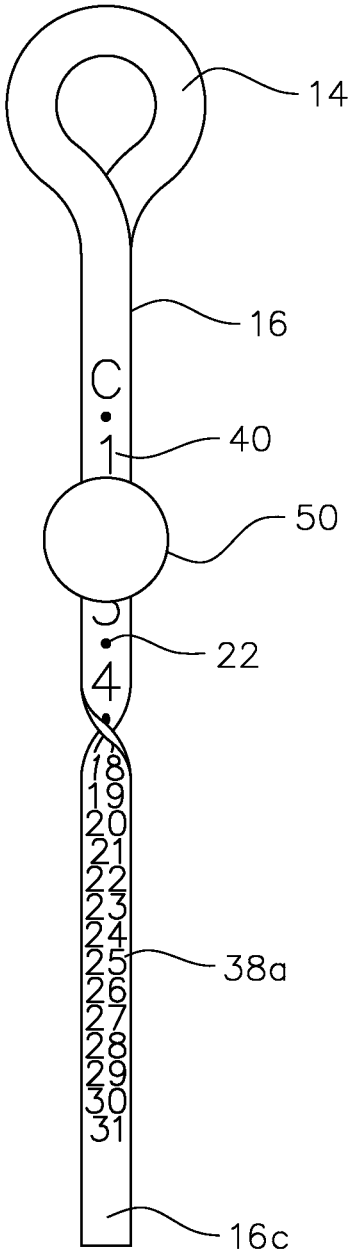
FIG. 10 is a conceptual depiction of a rather simple embodiment of the invention with indicia on one side of the ribbon/lanyard and a slidingly and frictionally engaging marker for indicating a desired indicia, in this case by way of example, the relative freshness of the associated garment and by way of example showing that the ribbon and/or product is reversible with other indicia on its back side, in this case, showing the date of a month.
Figure 11A:
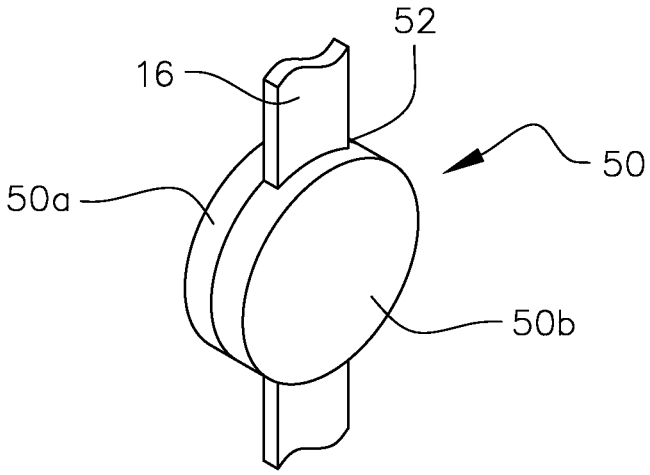
FIG. 11A is a conceptual depiction of an example of a construction for a marker similar to that used in FIG. 10.
Figure 11B:
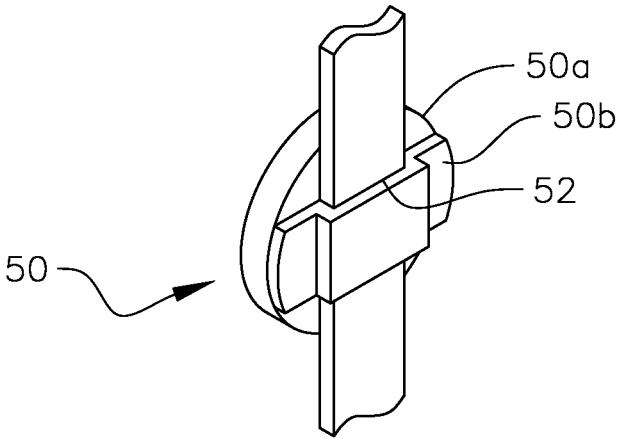
FIG. 11B is another conceptual depiction of an example of a construction for a marker similar to that used in FIG. 10.
Figure 12A:
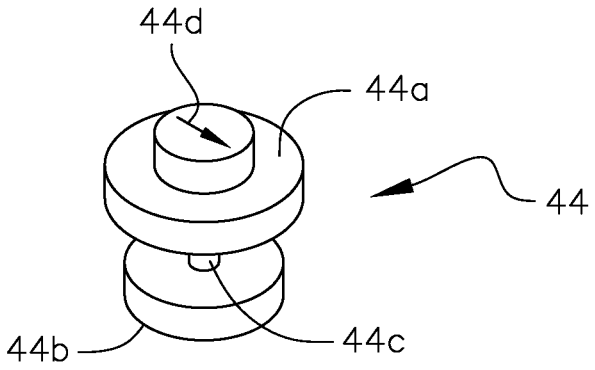
FIG. 12A is a conceptual depiction of an example of an engaging post marker used in the slotted portions of the embodiments depicted in FIGS. 8A-8C as well as in FIGS. 9A-9B.
Figure 12B:
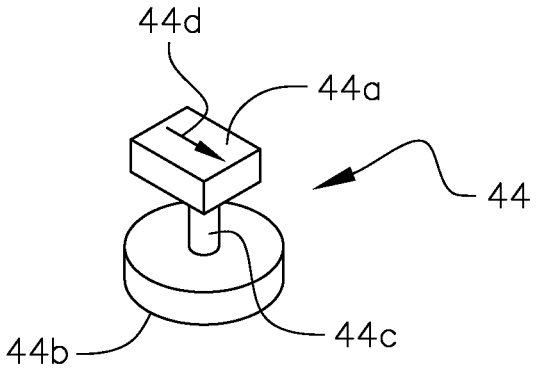
FIG. 12B is another embodiment of an example of an engaging post marker used in the slotted portions of the embodiments depicted in FIGS. 8A-8C as well as in FIGS. 9A-9B.
Figure 13A:
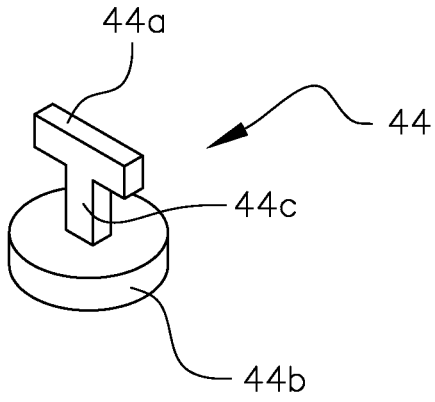
FIG. 13A is an alternative example of constructing a marker for use in the slotted portions of the embodiments depicted in FIGS. 8A-8C as well as in FIGS. 9A-9B.
Figure 13B:
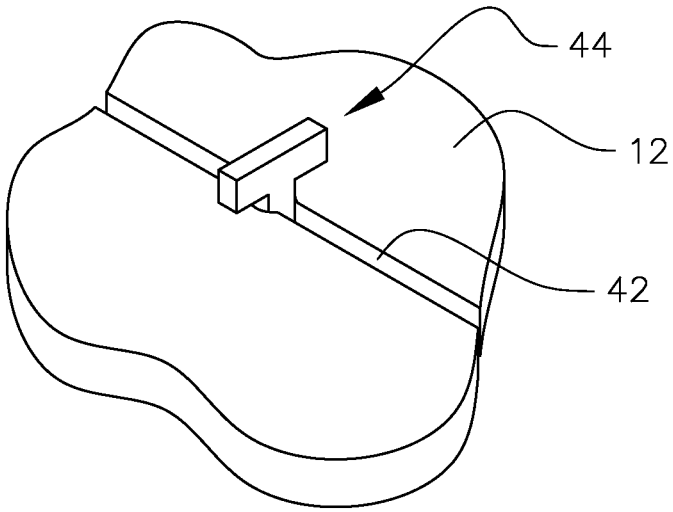
FIG. 13B is an area depiction partly showing the marker of FIG. 13A within the slotted portion of one of the embodiments depicted in FIGS. 8A-8C as well as in FIGS. 9A-9B.

In still another embodiment, which is depicted in FIG. 10, the ribbon or lanyard 16 with its loop 14 has a sliding marker 50 along the ribbon 16. The marker 50 may be made from a single piece construction using a molded plastic material or metal material. It has a front side 50*a* and a back side 50*b* such as construction examples shown in FIGS. 11A-11B. The marker 50 is frictionally engaged with the ribbon. The ribbon 16 has desired indicia such as wear indicia 40 on one side and optionally, the ribbon may have additional indicia such as day of the month indicia 38*a* on its back side to make the ribbon or product reversible. The front side 50*a* of the marker would be overlaid over the desired indicia on the front side of the ribbon/lanyard 16. The marker 50 used with this embodiment is configured to have a grooved portion 52 therein in which the ribbon or lanyard 16 can be inserted and slidingly engaged by friction within the marker grooved portion 52.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A garment tracking indicating device comprising:

a planar member, said planar member having two spaced-apart openings, one opening being above the other opening;

a flexible lanyard having a generally flat surface portion that extends from a back side of said planar member through the uppermost opening across part of a front side of said planar member and through the lower opening and continuing downwardly along said back side of said planar member, said lanyard further extending downwardly below a bottom edge of said planar member thereafter;

said lanyard having a single column of garment worn indicia thereon such that the indicia with the planar member indicates a specific number of times a garment associated with said garment tracking indicator has been worn or a specific level of said garment's cleanliness status, or a specific day of the week said garment was worn, said garment worn indicia being spaced-apart so that one of said garment worn indicia appears on the front side of said planar member at a time between said two spaced-apart openings, wherein the lanyard comprises a closed loop portion formed above said planar member for use in hanging said device from a hanger, said closed loop portion being integrally continuous to said lanyard and formed by attaching an end of the lanyard to itself.

2. The device according to claim 1, wherein said planar member further comprises a third opening spaced-apart and below said two spaced-apart opening, said third opening serving as means for inserting the lanyard from said back side of said planar member back through said third opening to depend from said front side of said planar member.

3. The device according to claim 1, wherein said lanyard is made from a flat ribbon material.

4. The device according to claim 1, wherein said lanyard or said planar member or a combination of said lanyard and said planar member is color coded to represent an association with a particular garment.

5. A garment tracking indicating device comprising:

a planar member, said planar member having two spaced-apart openings, one opening being above the other opening;

a flexible lanyard having a generally flat surface portion that extends from a back side of said planar member through the uppermost opening across part of a front side of said planar member and through the lower opening and continuing downwardly along said back side of said planar member, wherein the lanyard further extends downwardly below a bottom edge of said planar member and hangs free below said bottom edge;

said lanyard having a single column of garment worn indicia thereon such that the indicia with the planar member indicates a specific number of times a garment associated with said garment tracking indicator has been worn or a specific level of said garment's cleanliness status, or a specific day of the week said garment was worn, said garment worn indicia being spaced-apart so that one of said garment worn indicia appears on the front side of said planar member at a time between said two spaced-apart openings, wherein the lanyard comprises a loop portion formed above said planar member for use in hanging said device from a hanger, said loop portion being integrally continuous to said lanyard.

* * * * *